US006733722B2

(12) United States Patent
Singer et al.

(10) Patent No.: US 6,733,722 B2
(45) Date of Patent: May 11, 2004

(54) METHOD FOR PRODUCING A MOULDED BODY FROM FOAMED METAL

(75) Inventors: Robert F. Singer, Erlangen (DE); Carolin Korner, Feucht (DE)

(73) Assignee: Neue Materialien Furth GmbH, Furth (DE)

( * ) Notice: Subject to any disclaimer, the term of this patent is extended or adjusted under 35 U.S.C. 154(b) by 0 days.

(21) Appl. No.: 10/130,072

(22) PCT Filed: Sep. 11, 2001

(86) PCT No.: PCT/DE01/03477

§ 371 (c)(1),
(2), (4) Date: May 13, 2002

(87) PCT Pub. No.: WO02/22295

PCT Pub. Date: Mar. 21, 2002

(65) Prior Publication Data

US 2003/0049150 A1 Mar. 13, 2003

(51) Int. Cl.[7] ..... B22F 3/10; B22F 3/20
(52) U.S. Cl. ..... 419/2
(58) Field of Search ..... 419/2

(56) References Cited

U.S. PATENT DOCUMENTS 5,972,285 A * 10/1999 Knott ..... 419/2
5,976,454 A * 11/1999 Sterzel et al. ..... 419/2
6,171,532 B1 * 1/2001 Sterzel ..... 264/43

FOREIGN PATENT DOCUMENTS

EP 1 008 406 A2 6/2000

* cited by examiner

*Primary Examiner*—Daniel Jenkins
(74) *Attorney, Agent, or Firm*—Rankin, Hill, Porter & Clark LLP

(57) ABSTRACT

The invention relates to a process for producing a shaped body from metal foam, including the following steps:

Figure 1:
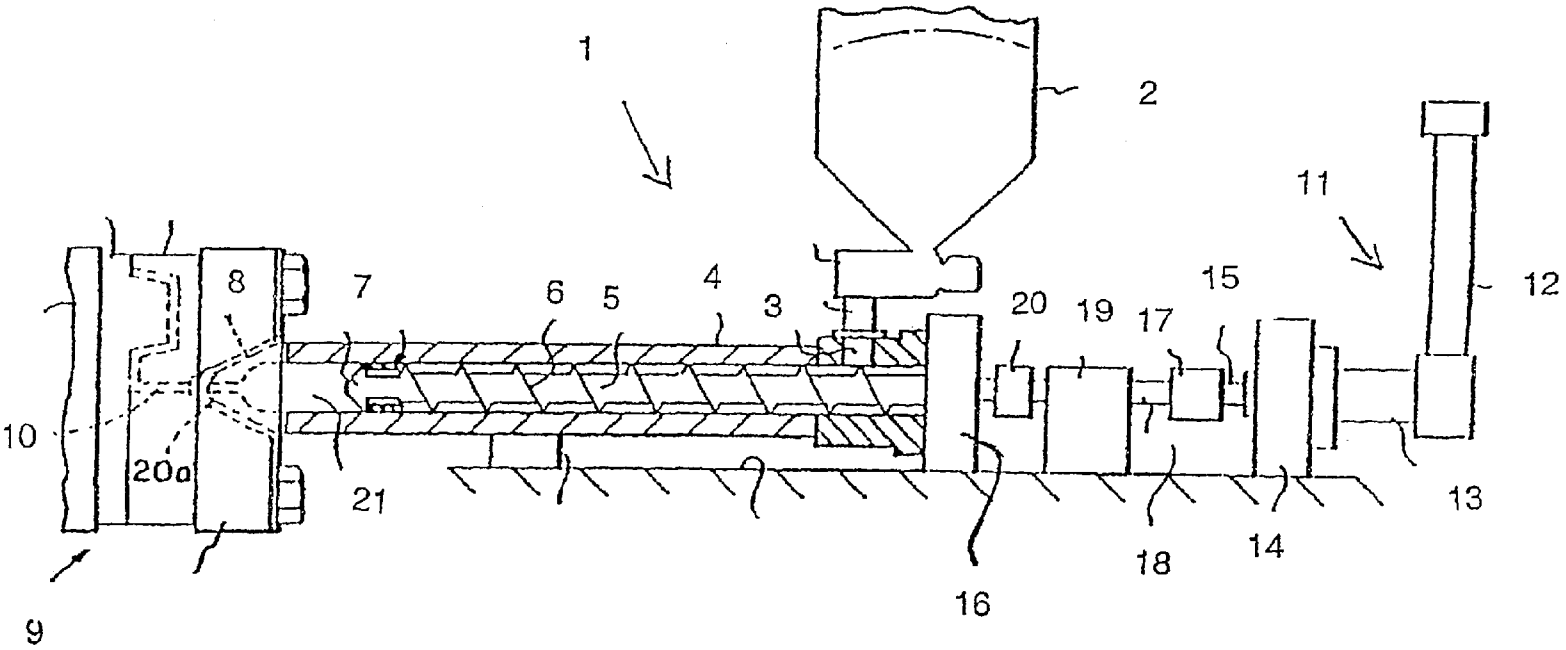

a) preparing a first powder, which is formed from the metal, and a second powder, which is formed from a blowing agent, b) feeding the first and second powders to an extrusion device, the first and second powders being in a non-compact form, c) conveying a powder mixture, which is formed from the first and second powders, in the extrusion device towards a casting mold, and, while conveying, at least partially melting the powder mixture to form an at least partially molten powder mixture and applying a pressure to the at least partially molten powder mixture, this pressure being greater than a gas pressure produced by the blowing agent, d) injecting the at least partially molten powder mixture into the casting mold, and e) relieving the pressure in the mold to a level that is lower than the gas pressure, so that the casting mold is completely filled with a metal foam that forms.

19 Claims, 2 Drawing Sheets

METHOD FOR PRODUCING A MOULDED BODY FROM FOAMED METAL

The invention relates to a process for producing a shaped body from metal foam.

EP 0 804 982 A2 has disclosed a process for producing shaped parts from metal foam, in which the starting material used is a compacted mixture of gas-releasing blowing agent and metal powder. A compacted mixture of this type is usually produced by extrusion. The compacted mixture may be in the form of rods, tubes or granules. To produce a metal foam, the compacted mixture is heated in a heatable chamber until the metal melts and the blowing agent decomposes. The gas which is then released causes the metal to foam. The metal foam which is formed is then pressed from the chamber into a casting mold by a plunger.

DE 197 34 394 A1 has disclosed a process in which, to produce a shaped part from a metal foam, the starting point is once again a compacted semifinished product. According to one alternative, it is also possible for the starting material used to be metal which cannot be foamed and for gas or a blowing agent to be supplied separately to the melt in order to form a metal foam.

It is known from DE 42 06 303 C1 to produce shaped bodies from metal foam by starting from a compacted starting material which is produced by a continuous extrusion process and is then comminuted.

DE 197 44 300 A1 has disclosed a further process for producing a shaped body which is formed from a metal foam. In this case, a semifinished product which is produced from a blowing agent which releases gas and a metal powder is heated in a receptacle. The metal foam which forms passes into a casting mold connected downstream.

The abovementioned processes disadvantageously require the expensive and time-consuming production of a compacted starting material or semifinished product. This usually requires the provision of a special device, for example an extrusion press.

DE 1 164 102 has disclosed a further process for producing shaped bodies from metal foam. In this case, a metal melt is fed to a mixer, where it is mixed with a gas-forming substance. To produce the metal melt, the process requires a separate melting device to be provided.

U.S. Pat. No. 5,865,237 has disclosed a process for producing shaped bodies from a metal foam. In this process, a heatable chamber is provided, which is connected to a casting mold. A compacted mixture which is accommodated in the heatable chamber, has been produced by powder metallurgy and contains the metal and a blowing agent is heated until a metal foam is formed. The metal foam is then forced into the casting mold.

The structure of the shaped body is dependent on the filling of the chamber, on the quality of mixing of the powder with the blowing agent and on the heating of the powder in the chamber. These parameters cannot always be set optimally and reproducibly. To ensure that as little blowing agent as possible is lost and to allow economic operation, on the one hand rapid heating is favorable. On the other hand, rapid heating leads to an uneven temperature distribution and to an uneven cell structure of the shaped body. The components which are produced using the known process have irregularities in their structure.

It is an object of the invention to eliminate the drawbacks of the prior art. The intention is, in particular, to provide a process with which shaped bodies comprising metal foam of constant quality can be produced as easily and inexpensively as possible.

This object is achieved by the features described in claim 1. Advantageous configurations result from the features described in claims 2 to 19.

The invention provides a process for producing a shaped body from metal foam, comprising the following steps:

a) providing a first powder, which is formed from the metal, and a second powder, which is formed from a blowing agent, b) feeding the first and second powders to an extrusion device, the first and second powders being in non-compacted form, c) conveying a powder mixture, which is formed from the first and second powders, in the extrusion device toward a casting mold, during which step it is at least partially melted and a pressure is applied to the at least partially molten powder mixture, this pressure being greater than a gas pressure produced by the blowing agent, d) injecting the at least partially molten powder mixture into the casting mold, and e) relieving the pressure to a level which is lower than the gas pressure, so that the casting mold is completely filled with a metal foam which forms.

In the process according to the invention, non-compacted powder is fed directly to an extrusion device, where it is mixed and at least partially melted. The expensive and time-consuming step of producing a compacted starting powder is avoided. There is no need to provide a special device for producing the compacted mixture.

The proposed process achieves intimate mixing of the at least partially molten powder mixture. Furthermore, in the extrusion device it is possible, without major additional outlay, to apply a pressure which counteracts undesirable premature decomposition of the blowing agent in the extrusion device. The heating of the powder mixture can be accurately controlled along the conveying path. Since the at least partially molten powder mixture is only expanded after it has emerged from the extrusion device into the casting mold, the formation of the metal foam is shifted into the casting mold. The formation of an irregular cell structure is avoided. The shaped bodies produced can be manufactured with a constant quality.

The first powder advantageously has a mean particle diameter in the range from 50 to 250 $\mu$m, preferably of 100 $\mu$m. The second powder may have a mean particle diameter in the range from 5 to 20 $\mu$m, preferably of 10 $\mu$m. According to a further design feature, there is provision for the first and second powders to be mixed before they are fed to the extrusion device. The first and/or the second powder may be supplied to the extrusion device under an inert gas atmosphere. This avoids undesirable oxidation of the powder. The quality of the components and their reproducibility are increased.

The first and second powders are expediently mixed in the extrusion device under the action of shear forces. The mixing and/or conveying of the powder mixture can be carried out by the rotary movement of a screw of the extrusion device. In this case, shear forces are also applied to the at least partially molten powder mixture. Undesirable growth of dendritic crystals is avoided. Approximately 100 revolutions per minute represents an advantageous rotational speed of the screw.

The powder or powder mixture is, advantageously heated continuously along a conveying path which extends from a feed opening toward an antechamber. Along the conveying path, the powder mixture is at least partially converted into a foamable melt in a single process step. In the process, both the powder mixture and the at least partially molten powder mixture are being continuously mixed. Furthermore, the powder mixture is conveyed toward an antechambers [sic] which accommodates the at least partially molten powder mixture. The process can be carried out at low cost using a single extrusion device. The separate production of a compacted starting material by extrusion, the subsequent comminution of the extruded semifinished product which may then be required, and the operation of transferring the compacted starting material into the extrusion device are eliminated.

In the extrusion device, the powder mixture is heated to a temperature which is higher than the solidus temperature. It is advantageous for the melt to be heated in the extrusion device to a temperature which is at most 50° C., preferably 20° C., above the liquidus temperature. It has proven particularly advantageous for the powder mixture to be heated to a temperature which lies in the range between the solidus temperature and the liquidus temperature. In this case, the powder mixture is only partially melted. The at least partially molten powder mixture may have a solid-phase content of 20 to 50%, preferably 30 to 40%. The at least partially molten powder mixture is expediently accumulated in a semi-solid thixotropic state in the antechamber. In the partially molten state, the viscosity is considerably increased compared to the completely molten state. This has the advantageous result that a continuous melt front is formed during injection into the casting mold. This means that undesirable atomization of the material which is injected into the casting mold and premature escape of the gas formed by the blowing agent are avoided. On account of the pressure relief in the casting mold, complete melting of the injected material is nevertheless achieved. In the case of injection of an only partially molten powder mixture, however, the release of the gas formed from the blowing agent is delayed. In this case, shaped bodies with a homogeneous foam structure are formed, i.e. in particular the formation of giant bubbles is prevented.

To keep the gas pressure which is generated as low as possible, it is expedient for the blowing agent used to be a pre-oxidized blowing agent.

The powder mixture can be heated in the extrusion device by means of an external heater device, for example by means of external strip heaters or an induction device. A heater device of this type allows accurate setting of the heating rate of the powder mixture in the extrusion device. This allows premature decomposition of the blowing agent and therefore expansion of the melt to be avoided. Furthermore, the temperature can be set in such a way that undesirable growth of dendritic metals is avoided. The build-up of a suitable pressure can be controlled using known mechanical and process engineering measures. It is expedient for a pressure of more than 10 bar, preferably of more than 30 bar, to be applied in the extrusion device above a temperature of more than 300° C.

The injection of the at least partially molten powder mixture can be effected by an axial movement of thee screw directed toward the casting mold. The extrusion device is expediently provided with a mechanical valve to optionally open and close an antechamber arranged downstream of the screw. Suitable devices are known, for example, from U.S. Pat. No. 5,040,589 or EP 0 409 966 B1, the disclosure of which is hereby incorporated.

According to a further design feature, the casting mold is preheated. This avoids excessively rapid solidification of the melt in the region of contact with the casting mold. To carry out the proposed process, the metal used is expediently magnesium or a magnesium alloy.

According to a further design feature, there is provision for a mold cavity which is surrounded by the casting mold to be increased in size after the injection. In this case, the casting mold used is expediently a positive mold. With a mold of this type, it is possible for at least one wall of the casting mold to be moved in the manner of a plunger, so that the size of the mold cavity is increased.

The metal used may be magnesium, aluminum, a magnesium alloy or an aluminum alloy. The blowing agent used may be a metal hydride, preferably $TiH_2$ or $MgH_2$. The blowing agent usually forms 0.5% by weight of the total weight of the powder.

Figure 2:
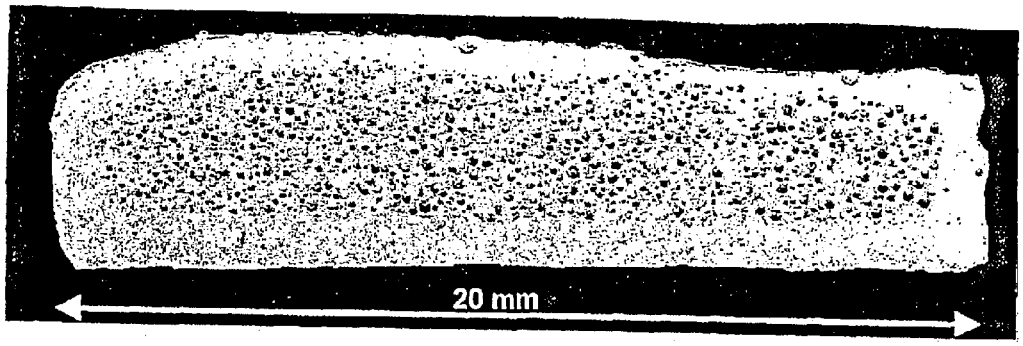
Figure 3:
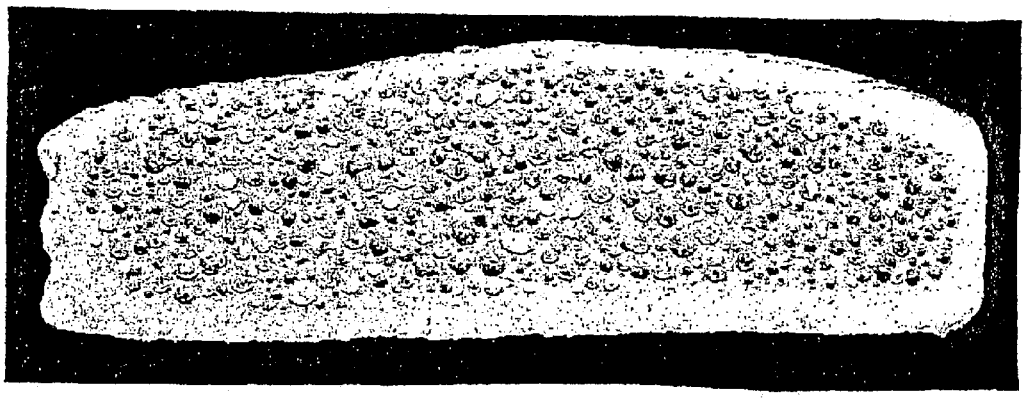

An exemplary embodiment of the invention is explained in more detail below with reference to the drawing, in which:

FIG. 1 shows a diagrammatic cross-sectional view of a device which is suitable for carrying out the process according to the invention, FIG. 2 shows a sectional view of a first shaped body, and FIG. 3 shows a sectional view of a second shaped body.

A hot-chamber die-casting machine, which is denoted overall by reference numeral 1 in FIG. 1, has a feed hopper 2, which is suitable for accommodating granules or powder. The granules or powder is/are conveyed via a conveyor device (not described in more detail) to the feed opening 3 of an extrusion cylinder 4.

To prevent the supplied material from being oxidized, the conveying device and the feed hopper 2 may be purged with inert gas. The inert gas used may, for example, be argon or nitrogen.

A screw 5 which is accommodated in the extrusion cylinder 4 can be rotated and moved in the axial direction. The screw 5 has a helically encircling blade 6. The free end of the screw 5 is denoted by reference numeral 7. The extrusion cylinder 4 has a die 8 at its outlet end. The die 8 opens into a gate of a two-part casting mold 9. It can be closed by means of a valve (not shown here). The two mold halves of the casting mold 9 form a mold cavity 10.

The opposite end of the screw 5 is connected to a high-speed injection appliance 11, which is known per se. This appliance has a storage battery 12 and a cylinder 13 which is accommodated in a fixed bearing 14, 16. A shot or injection plunger 15, which extends into a back-pressure bearing of a coupling 17, is arranged downstream of the cylinder 13. This allows connection in a manner known per se to a driveshaft 18, so that the injection plunger 15, when required, can move only in a reciprocating manner but cannot rotate. The driveshaft 18 extends in a conventional way through a rotary drive 19. This allows a horizontal reciprocating movement of the driveshaft 18 as a function of the movement of the injection plunger 15. The driveshaft 18 is coupled to the screw 5 in a known way via a drive coupling 20, in order to transmit the rotary movement to the screw 5. In the same way, an axial movement can be transmitted to the screw 5.

EXAMPLE 1

A powder is introduced via the feed hopper 2. The powder consists of an Mg alloy, e.g. of the type AZ 91. This powder has a mean particle size of 100 $\mu$m. It is mixed with an $MgH_2$ powder with a mean particle size of 10 $\mu$m, which is used as blowing agent. The blowing agent forms 0.5% by weight of the powder.

The premixed powder is conveyed via a conveying device, under an inert gas atmosphere, e.g. argon gas, to the feed opening 3 of the extrusion cylinder 4. The action of the screw 5 moves the powder mixture onward toward the die 8. At the same time, the powder mixture is increasingly heated and placed under pressure. The powder mixture is heated, for example, by external heater devices, e.g. strip heaters.

The screw 5 is rotated at approximately 100 revolutions per minute. As it comes closer to the die 8, the powder mixture is heated to a temperature which is higher than the solidus temperature of 465° C. The pressure in the antechamber, which is denoted by reference numeral 21, in the extrusion cylinder 4 is more than 30 bar. It may be up to 500 or 1000 bar. Shortly before injection, the temperature is approximately 20° C. higher than the liquidus temperature of the alloy, which is 596° C. The powder mixture is therefore in the completely molten state. The melt is homogeneously mixed. The pressure acting on the melt is greater in the antechamber 21 than the gas pressure which is generated by the blowing agent at the abovementioned temperature. Therefore, the melt does not foam.

As soon as there is sufficient melt in the antechamber 21, the die 8 can be opened. At the same time, the free end 7 of the screw 5 is shot toward the die 8 by means of the high-speed injection device 11. The melt passes into the mold cavity 10, where the pressure is relieved. The gas pressure is greater than the ambient pressure. The melt foams suddenly and completely fills the mold cavity 10. The mold halves of the casting mold 9 may advantageously be preheated.

EXAMPLE 2

The first powder used is an alloy which is produced from 99% of aluminum and 1% of magnesium and contains a small amount of silicon. The first powder has a mean particle size of approximately 100 $\mu$m. The second powder used is $TiH_2$ with a mean particle size of approximately 10 $\mu$m. The first and second powders are conveyed under an inert gas atmosphere, e.g. argon gas, to the feed opening 3 of the extrusion cylinder 4. The powder mixture is intensively kneaded along the conveying path which extends from the feed opening 3 to the antechamber 21 and is heated to a temperature of approximately 20° C. below the liquidus temperature, in this case approximately 630° C., by external heater devices. An argon pressure of 100 bar is applied. This causes the powder mixture to partially melt. The melt has a solid-phase content of approximately 35%.

As soon as the antechamber 21 has been filled with the partially molten powder mixture, the die 8 is opened. The partially molten powder mixture is injected into the casting mold in the thixotropic state. In the casting mold, the pressure is relieved to 26 bar.

FIG. 2 shows a sectional view, under a direct-light microscope, of a shaped body produced using the above process. The shaped body has an edge zone which is free of bubbles. On account of the injection of the material in the semi-solid thixotropic state, uncontrolled foaming of the melt in the casting mold is avoided. The cell structure is homogeneous.

EXAMPLE 3

The procedure is as in example 2. However, in the casting mold the pressure is relieved to 11 bar.

FIG. 3 shows an image, under a direct-light microscope, of a cross section through a shaped body produced in this way. The length of the specimen is once again 20 mm. It can be seen that the edge zone is once again substantially free of bubbles. The cells which are formed in the interior of the shaped body are homogeneously distributed. However, their mean cell size is greater than in the case of the shaped body illustrated in FIG. 2. This is attributed to the fact that in this case the melt has been expanded against a lower pressure.

LIST OF REFERENCE SYMBOLS

1 Hot-chamber die-casting machine
2 Feed hopper
3 Feed opening
4 Extrusion cylinder
5 Screw
6 Blade
7 Free end
8 Die
9 Casting mold
10 Mold cavity
11 High-speed injection appliance
12 Storage battery
13 Cylinder
14 Bearing
15 Injection plunger
16 Bearing
17 Coupling
18 Driveshaft
19 Rotary drive
20 Drive coupling
21 Antechamber

What is claimed is:

1. A process for producing a shaped body from metal foam, comprising the following steps:

a) providing a first powder, which comprises a metal, and a second powder, which comprises a blowing agent, b) feeding the first and second powders to an extrusion device (4, 5, 6, 7), the first and second powders being in a non-compacted form, c) conveying a powder mixture, which is formed from the first and second powders, in the extrusion device (4, 5, 6, 7) toward a casting mold (9), during which step the powder mixture is at least partially melted to form an at least partially molten powder mixture and a pressure is applied to the at least partially molten powder mixture, said applied pressure being greater than a gas pressure produced by the blowing agent, d) injecting the at least partially molten powder mixture into the casting mold (9), and e) relieving the applied pressure to a level that is lower than the gas pressure, so that the casting mold (9) is completely filled with a metal foam that forms.

2. The process according to claim 1, wherein the first powder has a mean particle diameter in the range from 50 to 250 $\mu$m, preferably of 100 $\mu$m.

3. The process according to claim 1, wherein the second powder has a mean particle diameter in the range from 5 to 50 $\mu$m, preferably of 10 $\mu$m.

4. The process according to claim 1, wherein the first and second powders are mixed before being fed to the extrusion device (4, 5, 6, 7).

5. The process according to claim 1, wherein the first and/or second powder is supplied to the extrusion device (4, 5, 6, 7) under an inert-gas atmosphere.

6. The process according to claim 1, wherein the first and second powders are mixed in the extrusion device (4, 5, 6, 7) under action of shear forces.

7. The process according to claim 1, wherein the mixing and/or conveying of the powder mixture is carried out by rotary movement of a screw (5) of the extrusion device (4, 5, 6, 7).

8. The process according to claim 1, wherein the powder mixture is heated continuously along a conveying path that extends from a feed opening (3) toward an antechamber (21).

9. The process according to claim 1, wherein the powder mixture is heated in the extrusion device (4, 5, 6, 7) to a temperature of at most 50° C., preferably 20° C., above the liquidus temperature.

10. The process according to claim 1, wherein the at least partially molten powder mixture has a solid-phase content of 20 to 50%, preferably of 30 to 40%.

11. The process according to claim 1, wherein the at least partially molten powder mixture is accumulated in a semi-solid thixotropic state in the antechamber (21).

12. The process according to claim 1, wherein the blowing agent used is pre-oxidized blowing agent.

13. The process according to claim 1, wherein the powder mixture is heated in the extrusion device (4, 5, 6, 7) by an external heater device.

14. The process according to claim 1, wherein a pressure of more than 10 bar, preferably more than 30 bar, is applied in the extrusion device (4, 5, 6, 7) above a temperature of more than 300° C.

15. The process according to claim 1, wherein the injection of the at least partially molten powder mixture is effected by an axial movement of a screw (5) directed toward the casting mold (9).

16. The process according to claim 1, wherein the casting mold (5) is preheated.

17. The process according to claim 1, wherein a mold cavity surrounded by the casting mold (9) is increased in size after the injection.

18. The process according to claim 1, wherein the metal is selected from the group consisting of magnesium, aluminum, a magnesium alloy and an aluminum alloy.

19. The process according to claim 1, wherein the blowing agent is a metal hydride, preferably $TiH_2$ or $MgH_2$.

* * * * *

UNITED STATES PATENT AND TRADEMARK OFFICE

CERTIFICATE OF CORRECTION

PATENT NO. : 6,733,722 B2
DATED : May 11, 2004
INVENTOR(S) : Singer et al.

It is certified that error appears in the above-identified patent and that said Letters Patent is hereby corrected as shown below:

Title page,
Insert Item:

-- [30] Foreign Application Priority Data

Sept. 13, 2000 (DE) 100 45 494.1 --.

Signed and Sealed this

Fourteenth Day of December, 2004

JON W. DUDAS
*Director of the United States Patent and Trademark Office*